US005345729A

United States Patent [19]

Prahst et al.

[11] Patent Number: 5,345,729

[45] Date of Patent: Sep. 13, 1994

[54] SUPPORT FOR TAMPER PROOF SECURING LIGHT FIXTURE ON SUSPENDED CEILING PANEL

[75] Inventors: Douglas Prahst, Milwaukee; Ralph H. Laird, New Berlin; Richard Kuchler, Big Bend; Lester G. Peterson, Milwaukee; William D. Benning, Hartland, all of Wis.

[73] Assignee: Wildeck, Inc., Waukesha, Wis.

[21] Appl. No.: 25,322

[22] Filed: Feb. 25, 1993

[51] Int. Cl.[5] ..... E04F 19/00

[52] U.S. Cl. ..... 52/28; 52/775; 52/780; 362/150

[58] Field of Search ..... 52/488, 775, 780, 781, 52/764, 484, 28; 362/147, 150

[56] References Cited

U.S. PATENT DOCUMENTS

| | | | |
|---|---|---|---|
| 3,597,889 | 8/1971 | Nigro | 52/28 |
| 3,786,602 | 1/1974 | Wilkin | 52/28 |
| 3,848,385 | 11/1974 | Thompson | 52/28 X |
| 4,047,336 | 9/1977 | Stahlhut et al. | 52/28 |
| 4,514,792 | 4/1985 | Klaus | 362/147 X |
| 5,263,295 | 11/1993 | Laird et al. | 52/588 X |

FOREIGN PATENT DOCUMENTS

| | | | |
|---|---|---|---|
| 478380 | 10/1969 | Switzerland | 362/150 |

*Primary Examiner*—Carl D. Friedman
*Assistant Examiner*—Lan C. Mai
*Attorney, Agent, or Firm*—Michael, Best & Friedrich

[57] ABSTRACT

A support for tamper proof securing a light fixture including a housing having a peripheral mounting flange on a ceiling panel including a fixture receiving opening having spaced apart side and end margins surrounding the fixture receiving opening and having inner and outer surfaces. The support has a hanger bracket which bridges the opening at a location between the end margins. Each of a pair of spaced apart jacks adjustably mounted on the hanger bracket has an abutment which is movable into a backstop position relative to the outer surface of the respective fixture receiving opening side margin. A suspension device on the hanger bracket is connectable with the light fixture housing, after the fixture housing has been inserted through the opening, for moving the fixture into a finally installed position wherein the side margins are clamped between the mounting flange of the fixture and the abutments on the jacks. In a preferred embodiment, the abutments are separate hold-down bars which extend along the side margins of the fixture receiving opening.

18 Claims, 2 Drawing Sheets

SUPPORT FOR TAMPER PROOF SECURING LIGHT FIXTURE ON SUSPENDED CEILING PANEL

BACKGROUND OF THE INVENTION

This invention relates to a support for mounting a light fixture and more particularly to a support for tamper proof mounting a light fixture of the type having a peripheral flange, into a fixture receiving opening in a suspended security ceiling panel.

Suspended security ceiling systems usually include a plurality of individual rectangular metal ceiling panels made of light gauge sheet steel, each having spaced apart side edges that terminate in upstanding rail portions. The sides of adjacent individual panels abut each other, the ends of each ceiling panel are supported on and secured to suitable supports mounted on the opposed walls of a room, and the abutting sides of adjacent rails are also secured together. When installed, none of the ceiling panels can be pushed or pried away from each other or from the wall supports for hiding contraband such as knives, razor blades, drugs, and the like.

Light fixture mounted openings in the ceiling panels can provide an easy route for breaching the integrity of the security ceiling installation. Light fixture openings are normally provided in one or more ceiling panels with each opening being located between the side rails of an individual panel. A light fixture is placed into the opening so that its peripheral flange is in abutting relation with the inner surface of the ceiling panel at the margin bordering the light fixture opening. The ceiling panels are made of light gauge sheet steel to reduce material cost, reduce the total weight of the installed suspended ceiling, and provide individual panels of light weight that can be easily fabricated and handled for fast, low labor cost installation. While the light gauge of the sheet metal forming the ceiling panel provides valuable advantages, it has the disadvantage of making it particularly easy for a person in the room, even without any tools, to manually deflect the edge of the ceiling panel adjacent the light fixture up and away from the light fixture peripheral flange, either for the purpose of providing storage space for hiding contraband or simply vandalizing.

The suspended ceiling system and light fixture typically are installed by different contractors. Light fixtures typically are supported from some kind of mounting means, such as chains or the like, suspended from the ceiling joist or other similar overhead support. An electrical contractor typically installs both the light fixtures and the support therefor.

The electrical contractor can install the light fixtures prior to or after installation of the ceiling panels. In the first case, workmen must go to the work site to install the light fixture supports before installation of the ceiling panels and then go back at a later time to install the light fixtures. This can cause potential conflicts in work scheduling, increase installation cost because of the time required to perform two separate work tasks and create the possibility of the light fixture support being installed at wrong locations. In the second case, workmen must install the light fixture supports while working through an opening in a ceiling panel for a light fixture. This can increase installation time because of the limited access.

SUMMARY OF THE INVENTION

A primary object of this invention is to provide a support for tamper proof mounting a light fixture on suspended ceiling panels which is simple in construction, low in cost, and convenient to install after the ceiling panels have been installed or in a light fixture receiving opening which is newly cut into an existing ceiling panel for the purpose of adding a light fixture.

Another object of the invention is to provide such a support which will positively clamp the deformable side margins of a ceiling panel bordering the light fixture opening between the support and the flange of the light fixture to prevent deflection of the ceiling panel away from a peripheral on a light fixture.

Other objects, aspects and advantages of the invention will become apparent to those skilled in the art upon reviewing the following detailed description, the drawings, and the appended claims.

The invention provides a support for tamper proof securing a light including a housing having a peripheral mounting flange on a ceiling panel including a fixture receiving opening having spaced apart side and end margins surrounding the fixture receiving opening and having inner and outer surfaces. When installed, the peripheral flange of the light fixture is in engagement with the inner surfaces of the ceiling panel side margins. The support comprises at least one hanger bracket that is positionable between the end margins and in bridging relation over the light fixture receiving opening, spaced away from interior of the room. The support also includes jack means mounted on the hanger bracket and having an adjustable abutment means movable into a back stop position with the outer surface each of the side margin when the hanger bracket is in a finally installed position. The hanger bracket further includes suspension means, which is connectable with the light fixture housing, after the housing is inserted through the fixture receiving opening. The suspension means enables the fixture housing to be drawn up into the fixture receiving opening to clamp the ceiling panel side margins between the peripheral flange of the fixture and the abutment means on the jack means when the fixture is in finally installed position.

Preferably, the jack abutment means includes a pair of elongated hold-down bars which engage and extend along the side margins of the fixture receiving opening and extendable means interposed the hanger bracket and each elongated hold-down bar and including a stop portion that is moveable into a back stop position against the hold-down bar. When the fixture in the finally installed position, any attempt to force deflection of either ceiling panel side margins away from the fixture flange will press it against the respective hold-down bar which is immoveable because of its engagement with the stop portion of the extendable means. Preferably, the extendable means comprise a pair of spaced apart jack bolts having a stop portion. The jack bolts are threadably mounted in the hanger bracket so that their stop portions can be adjustably positioned to engage a respective hold-down bar overlaying a side margin of the fixture receiving opening.

The hanger bracket also may include anchor means for securing the hanger bracket in a selected bridging position on the ceiling panel, spaced from an end margin of the fixture receiving opening, prior to insertion of the light fixture housing.

The support may be supplied as a kit of individual parts which can be assembled and installed on ceiling panels after a suspended ceiling system has been installed or when retrofitting a light fixture at a new location in a existing ceiling. In addition, the support may be suitably affixed to ceiling panels as part of manufacturing and the resulting unit shipped to the job site for installation.

DESCRIPTION OF THE PREFERRED EMBODIMENT

Figure 1:
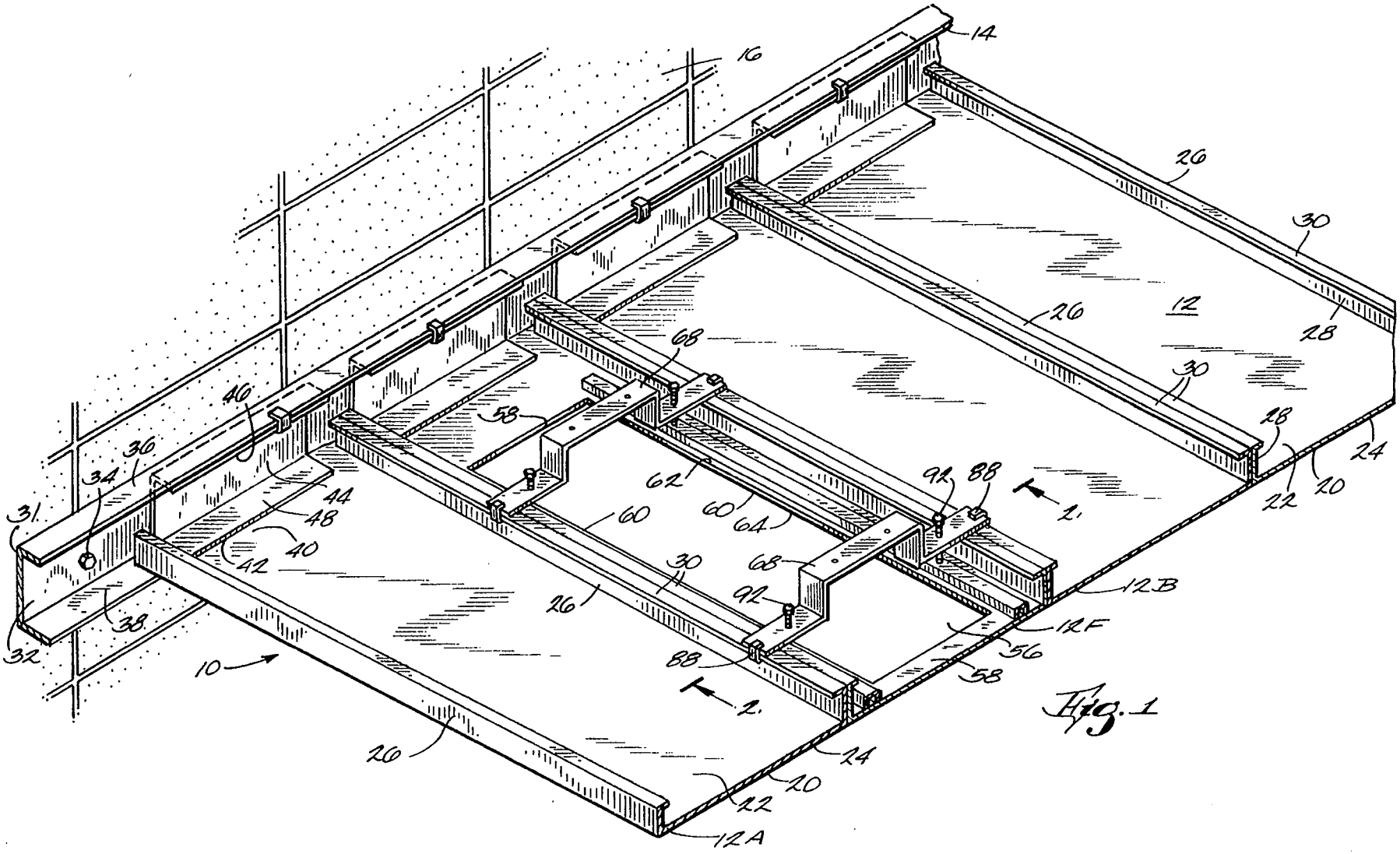
FIG. 1 is a fragmentary, isometric projection view, partially in section and from above, of a suspended security ceiling system consisting of a plurality of ceiling panels with one incorporating a light fixture receiving opening and a light fixture support of the invention.

FIG. 1 illustrates a portion of a suspended security ceiling system 10 for use in a room such as a prison or jail cell. The ceiling system 10 includes a plurality of rectangular ceiling panels 12, supported by channel shaped wall supports 14 (one shown) mounted on the opposed cell walls 16 (one shown). Each ceiling panel 12, which may be brake formed, rolled or otherwise fabricated from a light gauge sheet metal such as steel, includes an elongated planar web section 20 which can be solid or perforated as required. The web section 20 has an outer surface 22 facing away from the room, i.e., into the interior of the space above the ceiling, and an inner surface 24 facing the interior of the room. The web section 20 also has side rails 26 extending upwardly from and along the length of each of the opposite side edges thereof. The ceiling panels 12 typically can be up to 15 ft. in length and even longer when heavier sheet materials are used. Thus, for many applications a single ceiling panel 12 can span the width or length of the room without the need for any type of intermediate supports.

Figure 2:
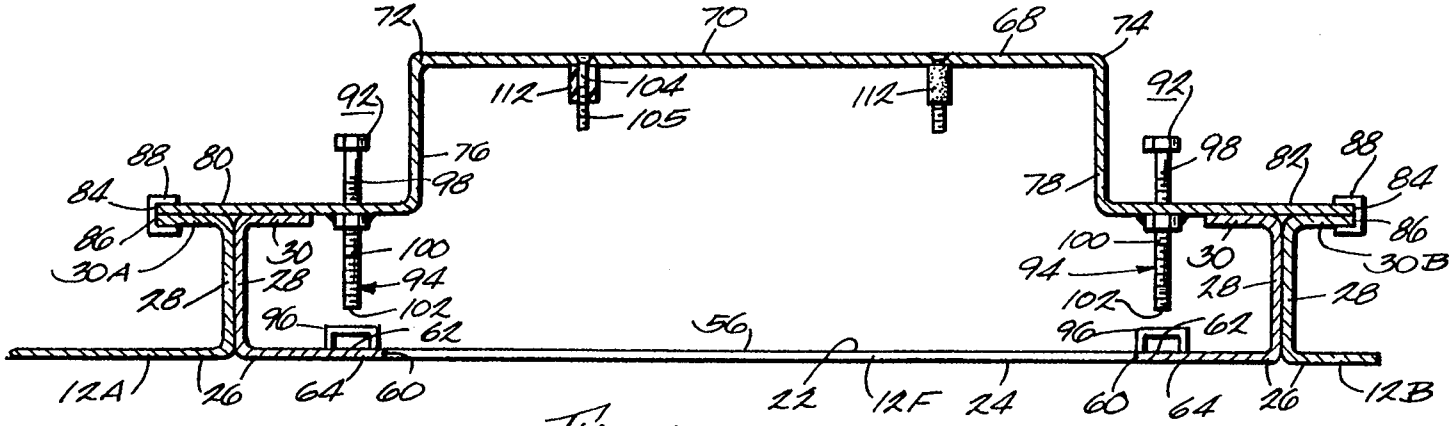
FIG. 2 is a sectional view taken generally along line 2—2 of FIG. 1.
Figure 3:
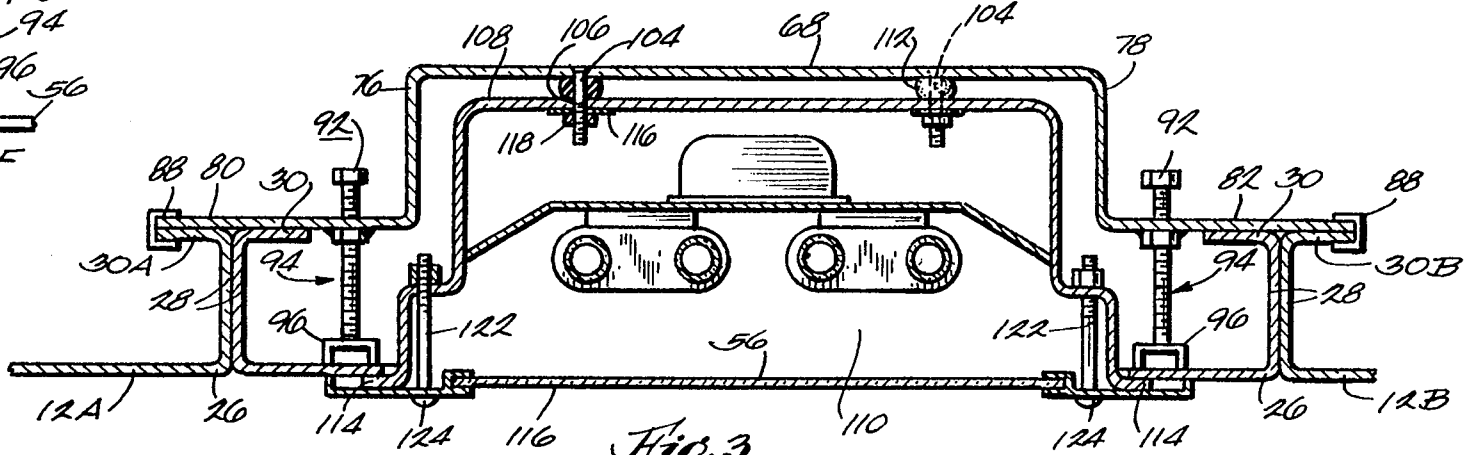
FIG. 3 is sectional view similar to FIG. 2 showing a light fixture finally installed on a ceiling panel.

Referring more particularly to FIGS. 1 and 2, each of the ceiling panel side rails 26 has a vertically extending side wall 28 and an inturned flange 30 which extends laterally inwardly from the top of each side wall 28. The flanges 30 normally are disposed horizontally when the ceiling panels 12 are installed. The side rails 26 can take any desired form or could be omitted if other suitable provisions are made for stiffening the ceiling panel against vertical deflection.

The wall supports 14 (FIG. 1) comprise a channel mender 31 having a vertical wall leg 32 which is mounted against the cell wall 16 by a plurality of bolts 34 anchored into the wall. The channel mender 31 further includes an upper flange 36 extending laterally inwardly from the upper portion of the vertical leg 32 and a lower flange 38 extending laterally inwardly from the lower portion of the vertical leg 32. The upper and lower flanges 36 and 38 are spaced apart a sufficient distance to enable end portions 40 of a plurality of ceiling panels 12 disposed side by side, with the side rails 26 of adjacent ceiling panels abutting, to fit therebetween with the web sections 20 resting on the lower flange 38 as illustrated in FIG. 1.

The ceiling panels 12 are held against the lower flanges 38 by individual channel-shaped retainer clips 42. Each retainer clip 42 includes a vertical leg 44 adapted to fit against or adjacent the vertical leg 32 of the wall support 14, a laterally inwardly extending upper leg 46 adapted to fit against the underside of upper flange 36 of the wall support 14, and a lower leg 48 adapted to fit against the outer surface of the web section 20 of a ceiling panel. The outside dimension between the upper and lower legs 46 and 48 of the retainer clips 42 approximates the inside dimension between the upper and lower flanges 36 and 38 of the wall channel 14 minus the thickness of the ceiling web section 20 so that there is a tight fit between the lower leg 48 of the retainer clip 42 and the web section 20 to prevent the end portions 40 of the ceiling panels 12 from being pushed or pried up and away from the lower flange 38 of the channel 14.

Referring to FIGS. 1 and 2, a ceiling panel 12 having the light fixture receiving opening 56 is designated by reference number 12F and the ceiling panels on each side of panel 12F are designated by reference numbers **12*a* and 12*b*. The light fixture receiving opening 56 is bordered or surrounded by opposed end and side margins 58, 60 having inner and outer surfaces 62, 64. A pair of light fixture supports in the forth of hanger brackets 68 are mounted over the light fixture receiving opening 56 at a location spaced inwardly from the end margins 58. As both hanger brackets 68 are of identical construction, only one of the hanger brackets 68 will be described in detail. It should be understood that one or more than two hanger brackets 68 can be used, depending on the length of the particular light fixture receiving opening 56**.

Referring to FIG. 2, the hanger bracket 68 is generally U-shaped when viewed in side elevation and comprises a center supporting portion 70 having spaced apart ends 72, 74; downcomer members 76, 78; and laterally extending foot portions 80, 82. The foot portions 80, 82 are connected to the downcomer members 76, 78 and are dimensioned to rest on the flanges 30 of abutting side rails 26. Thus, when the hanger bracket 68 is installed at the job site, the foot portion 80 extends laterally to cover the rail flange 30 on panel 12F and the rail flange on 30A on panel 12A and the foot portion 82 extends laterally to cover the opposed rail flange 30 on panel 12F and the rail flange 30B on panel 12B. The terminal edges 84 of the foot portions 80, 82 preferably are aligned with the longitudinal peripheral edges 86 of the rail flanges 30A, 30B and anchored at a selected location by a suitable fastener such one or more barbed spring clips 88.

Figure 4:
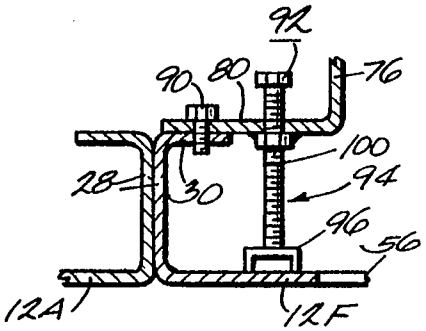
FIG. 4 is a partial sectional view of the hanger bracket shown in FIGS. 2 and 3 with end portions modified to facilitate assembly of the light fixture support on a ceiling panel at time of manufacture.

Referring to FIG. 4, if the hanger bracket 68 is to be preassembled on an individual ceiling panel 12F above the fixture receiving opening 56 during manufacture, the foot portions 80, 82 preferably extend laterally only up to the vertically extending side wall 28 of a rail 30 and are secured on the rail flanges 30 by any suitable fastening means 90 such as a spot weld, pop rivet or sheet metal screw.

The support hanger bracket 68 also includes a jack means 92 mounted on each hanger bracket foot portion 80, 82. The jack means 92 includes an adjustable abutment means 94 which can be moved into a back stop position above the outer surface 64 of the opening side margins 60 after the hanger bracket 68 has been anchored as described above. In the preferred embodiment illustrated, each abutment means 94 includes an elongated hold-down bar 96 which is laid on the outer surface 64 of one of the opposed side margin 60 of the fixture receiving opening 56. Each abutment means 94 also includes an extendable member 98 in the form of a jack screw having a threaded portion 100 threadably mounted in a foot portion 80, 82 of the hanger bracket 68 and a stop portion 102 which can be moved into the back stop position against the respective hold-down bar 96. As shown, the hold-down bars 96 preferably are channel shaped in cross section, but if desired, they can have a solid cross sectional dimension.

The support bracket hanger 68 further includes a suspension means 104 on the center portion 70. The suspension means 104 includes a pair of shank members 105, each having a threaded attachment portion which extends downwardly toward the fixture receiving opening 56. The shank members 105 are spaced apart to align with complementary mounting openings 106 in the housing 108 of a light fixture 110. A compressible member such as a sleeve 112 is of resilient material placed in surrounding relation to each of the shank members 105 as best shown in FIG. 2.

To accommodate a buildup of manufacturing tolerances and other similar dimensional variations, the compressible member preferably is supplied in the form of a tubing of rubber, or other suitable resilient material which can be conveniently cut with a knife or tin snips, several inches long. The installer can cut the tubing into sleeves of a length appropriate for a particular installation at the work site.

Referring to FIGS. 1 and 2, to install a light fixture 110 after the ceiling panels have been installed, two mounting brackets 68 are first inserted through the fixture receiving opening 56 in ceiling panel 12F and the respective foot portions 80, 82 are set on the rail flanges 30 of panels 12A, 12F, 12B. The foot portions 80, 82 of each bracket 68 are secured to the panel rails 26 with barbed spring clips 88 and the compressible rubber sleeves 112 are slipped over the threaded members 104. A hold-down bar 96 is laid on the outer surface 64 of each side margin 60 adjacent the fixture receiving opening 56. The jack screws 100 are threaded downwardly until the stop portions 102 are in abutting back stop engagement with the hold-down bars 96. The light fixture 110 has a peripheral mounting flange 114 and security lens 116. The light fixture 110, with the security lens 116 removed, is inserted into the fixture receiving opening 56 with the mounting apertures 106 in the light fixture housing 108 aligned with the shank members 105. After the light fixture housing 108 has been pushed upwardly far enough for the shank members 105 to extend through the apertures 106, fender washers 116 and nuts 118 are threaded onto shank menders 105. As the nuts 118 are threaded onto the shank menders 105, the light fixture 110 is drawn into the light receiving opening 56 compressing sleeves 112 until the peripheral mounting flange 114 engages the inner surfaces 64 of the ceiling panel side margins 60 and thereby clamp the panel side margins 60 between the fixture flange 114 and the hold-down bars 96. The security lens 116 is then mounted on the flange and secured in place by security fasteners 122. The heads 124 of the security fasteners 122 are constructed so that the fasteners 122 cannot be loosened without the use of a special tool.

When the light fixture 110 is in a finally installed position, the ceiling panel side margins 60 bordering the fixture receiving opening 56 are tightly clamped between the hold-down bars 96 and the peripheral flange 114 of the light fixture housing 108. In this clamped relationship, it is virtually impossible for a person in the room to pry or otherwise distort the ceiling panel side margins 60 away from the light fixture flange 114 to provide a space for hiding contraband.

As previously mentioned, a ceiling panel unit including a light receiving opening 56 may be fabricated at the factory with one or more hanger brackets 68 pre-installed across the spaced apart side rails 26. After the ceiling panel 12A with the pre-installed hanger bracket or brackets 68 is in place in the ceiling, the hold-down bars 96 and light fixture 110 is installed in the opening 56 in the manner described above.

We claim:

1. A support for tamper proof securing a light fixture including a housing having a peripheral mounting flange on a ceiling panel including a fixture receiving opening having spaced apart side and end margins surrounding the fixture receiving opening and having inner and outer surfaces, said support comprising:

at least one hanger bracket positionable between the end margins of and in bridging relation over the fixture receiving opening;

a pair of jack means mounted on said hanger bracket having an adjustable abutment means movable into a back stop position relative to the outer surfaces of a ceiling panel side margins on opposite sides of the fixture receiving opening when said hanger bracket is installed; and suspension means on said hanger bracket, connectable with the light fixture housing after the light fixture housing is inserted through the fixture receiving opening, for moving the fixture into a finally installed position within the fixture receiving opening wherein the ceiling panel side margins are clamped between the fixture mounting flange and said abutment means.

2. The support according to claim 1 wherein said abutment means includes an elongated hold-down bar adapted to rest on the outer surface of and extend along a ceiling panel side margin.

3. The support according to claim 2 wherein said abutment means further includes extendable means interposed said hanger bracket and each of said elongated hold-down bars, said extendable means having a stop portion movable to said back stop position against a respective one of said hold-down bars to prevent forced deflection of the ceiling panel side margins and hold-down bars after the light fixture is in a finally installed position.

4. The support according to claim 3 wherein each of said extendable means includes a jack bolt having a said stop portion thereon, said jack bolts threadably mounted in said hanger bracket so that said stop portion can be positioned above and moved into engagement with a said hold-down bar overlaying the outer surface of a ceiling panel side margin.

5. The support according to claim 3 wherein said hanger bracket has opposed foot portions spaced apart a distance sufficient to span beyond the ceiling panel side margins and a said jack bolt is threadably mounted in each of said foot portions.

6. The support according to claim 5 wherein said hanger bracket includes a center support having spaced apart opposed ends and a downcomer member depending from each of said ends and a said foot member is connected to each of said downcomer members.

7. The support according to claim 2 wherein said hanger bracket includes anchor means for securing said hanger bracket in a selected bridging position after installation on a ceiling panel over the fixture receiving opening.

8. The support according to claim 1 wherein said suspension means includes at least one shank men, bet having an attachment portion removably securable to the light fixture housing and a compressible member mounted between said hanger bracket and the light fixture housing when the light fixture is in a finally installed position.

9. The support according to claim 8 wherein said compressible member comprises a tubular sleeve of resilient material in surrounding relation to said shank member.

10. The support according to claim 1 for use in a suspended ceiling including ceiling panels having spaced apart, opposed side rails and a light fixture receiving opening located between the side rails, wherein said hanger bracket has opposed foot portions spaced apart from each other at a distance to enable said foot portions to rest the opposed side rails of the ceiling panel on which the hanger bracket is to be installed.

11. A ceiling panel unit including a support for a light fixture including a housing having a peripheral mounting flange, said unit comprising:

a ceiling panel including a planar web section having spaced apart side edges, a rail portion on each of said side edges, a light fixture receiving opening located between said side edges and including end and side margins surrounding said fixture receiving opening and having inner and outer surfaces;

at least one hanger bracket mounted on said side rails and extending in bridging relation over said fixture receiving opening above the outer surface of said side margins;

a pair of jack means interposed said hanger bracket and the outer surfaces of said side margins and having adjustable abutment means movable into a back stop position relative to the outer surface of the respective one of said side margin; and suspension means on said hanger bracket connectable with light fixture housing, after the light fixture housing is inserted through said fixture receiving opening, for moving the light fixture into a finally installed position within said fixture receiving opening wherein said ceiling panel side margins are clamped between the light fixture mounting flange and said abutment means.

12. The ceiling panel unit according to claim 11 wherein each of said abutment means includes an elongated hold-down bar overlaying the outer surface of and extending along a respective one of said side margins.

13. The ceiling panel unit according to claim 12 wherein said abutment means further includes an extendable means interposed between said hanger bracket and each of said elongated hold-down bars, said extendable means having a stop portion move to said back stop position against the respective one of said hold-down bars to prevent forced deflection of the said side margins and said hold-down bars when the light fixture is in a finally installed position.

14. The ceiling panel unit according to claim 13 wherein each of said extendable means includes a jack bolt having said stop portion thereon, said jack bolt threadably mounted in said hanger bracket so that said stop portion can be positioned above and moved into engagement with a said hold-down bar when said hanger bracket is installed.

15. The ceiling panel unit according to claim 13 wherein said hanger bracket has opposed foot portions spaced apart a distance sufficient to span beyond said side margins and a said jack bolt is threadably mounted in each of said foot portions.

16. The ceiling panel unit according to claim 15 wherein said hanger bracket includes a center support having spaced apart opposed ends and a downcomer member depending from each of said ends and a said foot member is connected to each of said downcomer members.

17. The ceiling panel unit according to claim 11 wherein said suspension means includes at least one shank member having an attachment portion removably securable to the light fixture housing and a compressible member mounted between said hanger bracket and the light fixture housing when the light fixture is a finally installed position.

18. The ceiling panel unit according to claim 17 wherein said compressible member comprises a tubular sleeve of resilient material in surrounding relation to said shank member.

* * * * *

UNITED STATES PATENT AND TRADEMARK OFFICE

CERTIFICATE OF CORRECTION

PATENT NO. : 5,345,729

DATED : September 13, 1994

INVENTOR(S) : Douglas Prahst et al

It is certified that error appears in the above-indentified patent and that said Letters Patent is hereby corrected as shown below:

Column 7, line 9 "men, bet" should read --member--

Signed and Sealed this

Fifteenth Day of November, 1994

Bruce Lehman

*Attest:*

BRUCE LEHMAN

*Attesting Officer*

*Commissioner of Patents and Trademarks*